US010731430B2

(12) United States Patent
LaGrange et al.

(10) Patent No.: US 10,731,430 B2
(45) Date of Patent: Aug. 4, 2020

(54) PERFORATING GUN

(71) Applicant: OWEN OIL TOOLS LP, Houston, TX (US)

(72) Inventors: Timothy E. LaGrange, Ponoka (CA); Ian Morrison, Grandbury, TX (US); Jeffrey D. Wood, Keller, TX (US); Jeffrey Gartz, Lancombe (CA)

(73) Assignee: OWEN OIL TOOLS LP, Houston, TX (US)

( * ) Notice: Subject to any disclaimer, the term of this patent is extended or adjusted under 35 U.S.C. 154(b) by 0 days.

(21) Appl. No.: 16/325,337

(22) PCT Filed: Oct. 3, 2017

(86) PCT No.: PCT/US2017/054980
§ 371 (c)(1),
(2) Date: Feb. 13, 2019

(87) PCT Pub. No.: WO2018/067598
PCT Pub. Date: Apr. 12, 2018

(65) Prior Publication Data

US 2019/0284889 A1 Sep. 19, 2019

Related U.S. Application Data

(60) Provisional application No. 62/403,509, filed on Oct. 3, 2016.

(51) Int. Cl.
*E21B 23/08* (2006.01)
*E21B 43/116* (2006.01)
(Continued)

(52) U.S. Cl.
CPC ..... *E21B 23/08* (2013.01); *E21B 43/116* (2013.01); *E21B 43/119* (2013.01); *E21B 43/26* (2013.01);
(Continued)

(58) Field of Classification Search
CPC ..... E21B 23/08; E21B 43/119; E21B 43/116; E21B 43/26; E21B 47/04; E21B 47/09; E21B 47/0905
See application file for complete search history.

(56) References Cited

U.S. PATENT DOCUMENTS 6,759,968 B2 7/2004 Zierolf
7,363,967 B2 * 4/2008 Burris, II ..... E21B 23/00 166/66
(Continued)

FOREIGN PATENT DOCUMENTS

EP 2282002 A2 2/2011

OTHER PUBLICATIONS

PCT Application No. PCT/US2017/054980—International Search Report dated Feb. 5, 2018.

*Primary Examiner* — Daniel P Stephenson
(74) *Attorney, Agent, or Firm* — Mossman Kumar & Tyler PC

(57) ABSTRACT

A well tool (60) includes a perforating gun (108), a sealing element (130), at least one pressure sensor (150), a detector (132), a controller (152), and an anchor (134). The perforating gun (108) perforates the wellbore tubular in response to a firing signal. The sealing element (130) is connected to the perforating gun (108) and generates a pressure differential thereacross. The at least one pressure sensor (150) is associated with the sealing element (130) and detects a surface transmitted pressure signal. The detector (132) detects at least one marker (70) positioned along the wellbore (12) and which includes a perforating marker (70) associated with a perforating depth. The controller (152) is in signal communication with the at least one pressure sensor (150) and the detector (132) and is configured to transmit the firing signal to the perforating gun (108) only after: (i) the at least one pressure sensor (150) detects the
(Continued)

surface transmitted pressure signal, and (ii) the detector (132) detects the perforating marker (70). The anchor (134) is connected to the perforating gun (108) and selectively locks the perforating gun (108) to the wellbore tubular.

15 Claims, 3 Drawing Sheets

(51) Int. Cl.

| | |
|---|---|
| ***E21B 43/119*** | (2006.01) |
| ***E21B 47/09*** | (2012.01) |
| ***E21B 47/04*** | (2012.01) |
| ***E21B 43/26*** | (2006.01) |

(52) U.S. Cl.
CPC ..... *E21B 47/04* (2013.01); *E21B 47/09* (2013.01); *E21B 47/0905* (2013.01)

(56) References Cited

U.S. PATENT DOCUMENTS

| | | | | |
|---|---|---|---|---|
| 9,140,818 | B2 | 9/2015 | Zierolf | |
| 9,284,819 | B2 * | 3/2016 | Tolman | E21B 33/134 |
| 9,903,192 | B2 * | 2/2018 | Entchev | E21B 43/263 |
| 2005/0241824 | A1 | 11/2005 | Burris, II et al. | |
| 2013/0062055 | A1 * | 3/2013 | Tolman | E21B 47/09 166/250.01 |
| 2014/0131035 | A1 | 5/2014 | Entchev et al. | |
| 2019/0284889 | A1 * | 9/2019 | Lagrange | E21B 23/08 |

* cited by examiner

PERFORATING GUN

TECHNICAL FIELD

The present disclosure relates to devices and method for perforating and fracturing a subterranean formation.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun that is generally comprised of a steel tube "carrier," a charge tube riding on the inside of the carrier, and with shaped charges positioned in the charge tube. "Plug and Perf" is a technique in which a bottom hole assembly is run in hole (typically on wireline or tubing), a bridge plug is set, and one or more perforating guns are detonated to provide communication between the wellbore and formation.

The present disclosure addresses the need for more cost-efficient perforating guns for perforating and fracturing a formation.

SUMMARY

In aspects, the present disclosure provides a well tool for use in a wellbore tubular disposed in a wellbore formed in an earthen formation. The well tool may include a perforating gun, a sealing element, at least one pressure sensor, a detector, a controller, and an anchor. The perforating gun perforates the wellbore tubular by firing in response to a firing signal. The sealing element is connected to the perforating gun and generates a pressure differential across the perforating gun in response to a fluid pumped into the wellbore tubular. The pressure sensor(s) are associated with the sealing element and detect a surface transmitted pressure signal. The detector detects at least one marker positioned along the wellbore. The at least one marker includes a perforating marker associated with a perforating depth. The controller is in signal communication with the at least one sensor and the detector and is configured to: transmit the firing signal to the perforating gun only after: (i) the at least one pressure sensor detects the surface transmitted pressure signal, and (ii) the detector detects the perforating marker. The anchor is connected to the perforating gun and selectively locking the perforating gun to the wellbore tubular.

In aspects, the present disclosure provides a method for performing a well operation. The method may include configuring a perforating gun to only be responsive to a firing signal after receiving a command signal; propelling a perforating gun through the wellbore tubular by pumping a fluid into a bore of the wellbore tubular, wherein a sealing element surrounding the perforating gun generates a pressure differential that propels the perforating gun; transmitting a command signal from the surface in the form of pressure in the pumped fluid; perforating a section of the wellbore by transmitting the firing signal to the perforating gun after receiving the command signal; anchoring the perforating gun in the wellbore tubular at a depth downhole of the perforated section of the wellbore tubular by using an anchor; hydraulically isolating the perforated section of the wellbore tubular from a remainder of the wellbore downhole of the perforating gun using a sealing element; and pumping a fracturing fluid into the wellbore tubular to fracture a formation surrounding the perforated section of the wellbore.

It should be understood that certain features of the disclosure have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
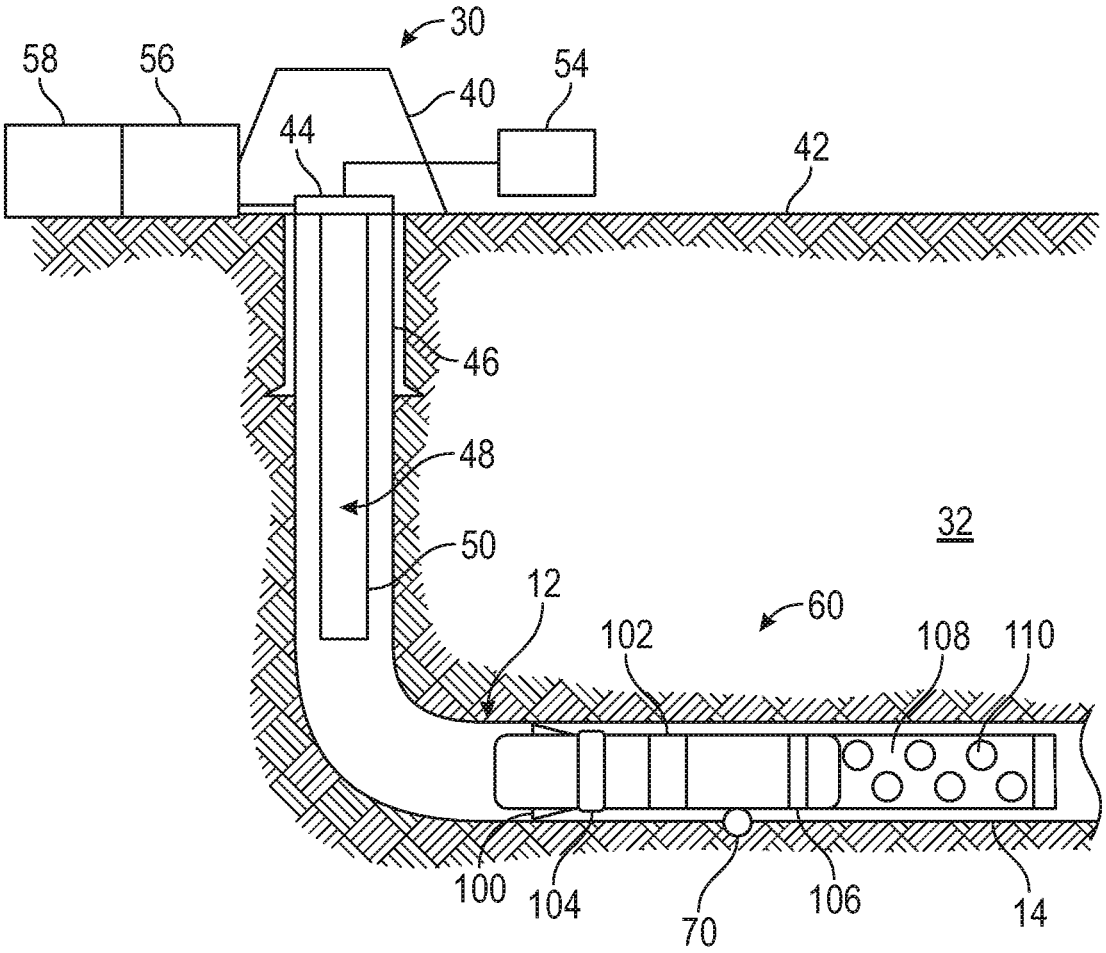
FIG. 1 schematically illustrates a well in which embodiments of the present disclosure may be deployed.

The present disclosure relates to devices and methods for perforating and hydraulically fracturing a formation intersected by a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is shown a well construction and/or hydrocarbon production facility 30 positioned over subterranean formations of interest 32. The facility 30 can be a land-based or offshore rig adapted to drill, complete, or service the wellbore 12. The facility 30 can include known equipment and structures such as a platform 40 at the earth's surface 42, a wellhead 44, and casing 46. A work string 48 suspended within the well bore 12 is used to convey tooling into and out of the wellbore 12. The work string 48 can include coiled tubing 50 injected by a coiled tubing injector (not shown). Other work strings can include tubing, drill pipe, wire line, slick line, or any other known conveyance means. A surface control unit (e.g., a communication module, a power source and/or firing panel) 54 can be used to monitor, communicate with, and/or operate tooling in the wellbore 12. The facility 30 also includes a pump 56 for pumping a pressurized fluid into the wellbore 12 and a pump 58 for pumping a hydraulic fracturing fluid into the wellbore 12. In one embodiment, the pressurized fluid may be used to convey information encoded pressure signals, which is known as mud pulse telemetry. Such signals may be generated by manipulating the flowing fluid; e.g., increasing or decreasing fluid flow. As used herein, a "pressurized fluid," which may be a drilling fluid, stays principally within the wellbore 12 whereas a hydraulic fracturing fluid is principally designed to penetrate into the formation 32.

A perforating and hydraulic fracturing operation at one or more target depths may be performed by a perforating tool 60. The perforating tool 60 may identify the target depth(s) using one or more markers 70. The markers 70 may be in the wellbore 12 or in the formation. The perforating tool 60 may include a propulsion device 100, detector 102, an anchoring device 104, a firing mechanism 106, and a perforating gun 108. In one embodiment, a perforating tool 60 may be propelled through the wellbore 12 using the pressurized fluid supplied by the pump 56. The work string 48 may be optionally be used to convey the perforating tool 60 for some distance (e.g., along a vertical section of the wellbore 12). In such instances, the perforating tool 60 may be released from the work string 48 by activating a suitable latching mechanism. Thereafter, fluid pressure pushes the perforating tool 60 toward one or more target depths.

Figure 2:
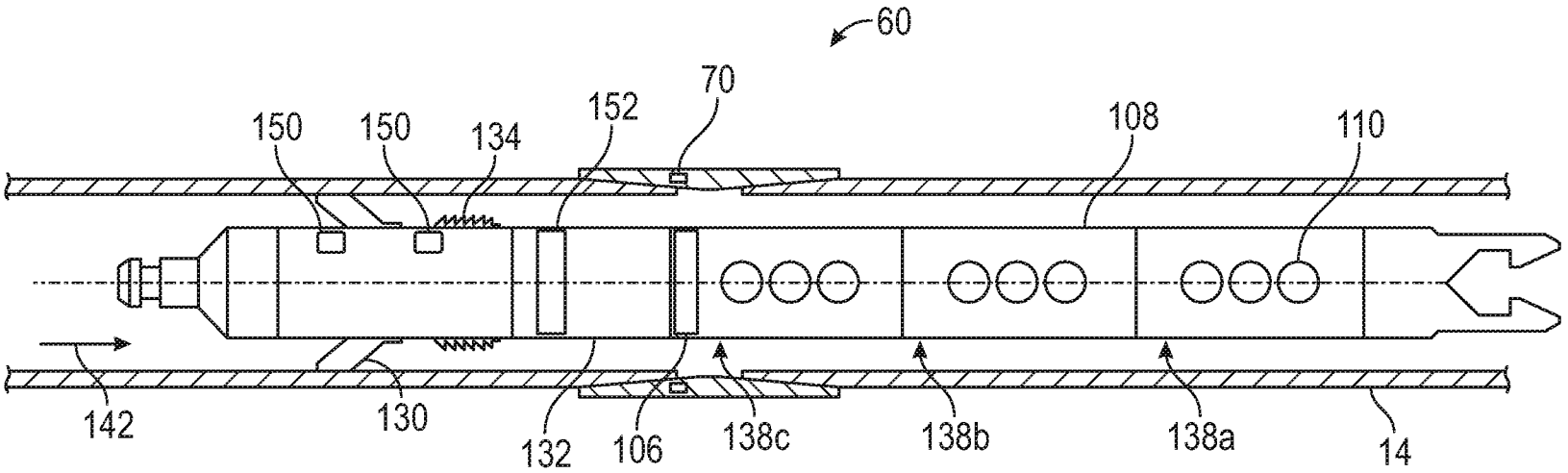
FIG. 2 schematically illustrates a side view of an perforating gun according to one embodiment of the present disclosure being conveyed in a wellbore.

Referring to FIG. 2, there is schematically shown one embodiment of a perforating tool 60 according to the present teachings. The perforating tool 60 may include a sealing element 130 that acts as the propulsion device 100 (FIG. 1), a marker reader 132 for detecting markers 70, an anchor 134 for anchoring against the casing 14, a firing mechanism 106, one or more pressure sensors 150, a downhole controller 152, and a perforating gun 108.

The sealing element 130 may be used to generate a pressure differential that pushes the perforating tool 60 through the wellbore 12. Generally, the sealing element 130 may be an annular packer, lip, or shoulder that reduces the flow area between the perforating tool 60 and a wall of the casing 14. The sealing element 130 may be rigid or have a variable diameter and can seal partially or completely against the casing 14. For instance, the sealing element 130 may be an annular elastomeric member that surrounds the perforating tool 60 and forms a partial or complete fluid barrier against an inner wall 140 of the casing 14. During downhole fluid flow, shown by arrow 142, the sealing element 130 generates a pressure differential of sufficient magnitude to axially displace the perforating tool 60 in the downhole direction shown by arrow 142.

The marker reader 132 locates one or more predetermined target depths in the wellbore for a desired perforating and fracturing operation by detecting the marker(s) 70. In this embodiment, the marker 70 may be an object that has a specific magnetic, radioactive, or electromagnetic signature that can be detected by the marker reader 132. The marker reader 132 may include suitable hardware for measuring electromagnetic signals or radiation and circuitry (not shown) for determining whether the measurements correlate with a signature of a marker. The circuitry (not shown) also may include memory modules for storing data relating to the marker and processors for sending appropriate control signals when a correlation is present. It should be noted that such circuitry and processors may be a part of the controller 152.

One non-limiting example of a suitable marker 70 may be a RFID tag or radioactive tag at the predetermined target depth. In such arrangements, the marker reader 132 may be configured to use the appropriate mechanism to detect the tag (e.g., using RF waves or detecting radiation). The marker reader 132 may also include a uni-directional or bi-directional communication device, which may also be a part of the controller 152. Such devices may be used by the marker reader 132 to transmit downhole information (e.g., location/position information) to the surface and/or receive command signals (e.g., set the tool or fire the gun) from the surface. Thus, while the marker reader 132 may be a discrete component, the marker reader 132 may also be a part of the controller 152.

The controller 152 may be configured to fire the perforating gun 108 by sending a firing signal. The controller 152 and the perforating gun 108 may be considered to have two or more operating states depending on a measured pressure reading at the sealing element 130. For example, in a "safe" state either the controller 152 cannot send a firing signal or the perforating gun 108 is not responsive to the firing signal. The "safe" state may be present when the measured pressure is below a preset or predetermined pressure. In an "armed" state, the controller 152 can send a firing signal and the perforating gun 108 is responsive to the firing signal. The "armed" state may be present when the measured pressure is at or above a preset or predetermined pressure.

Initially, the controller 152/perforating gun 108 are in the "safe" state. To switch states, a command signal in the form of a pressure increase can be generated by personnel at the surface by operating the pumps to generate the desired predetermined pressure at the perforating tool 60. That is, communication between the perforating tool 60 and personnel at the surface is enabled by using pressure signals conveyed in the flowing fluid. In one arrangement, the pressure sensor(s) 150 may be used to measure a pressure differential across the sealing element 130. The controller 152 may be in signal communication with the pressure sensors 150 and programmed with a predetermined pressure value or range of values. The controller 152 may be an electromechanical, electrical, and may include one or more microprocessors with programmable circuitry.

In an illustrative mode of operation, the perforating gun 108 can only be fired by a command from the marker reader 132 after an "armed" state exists at the controller 152. In some embodiments, a separate safety device (not shown) may independently, or cooperatively with the controller 152, prevent a detonator (not shown) from receiving a signal that could be interpreted as a firing signal. For example, the safety device (not shown) may be an electrical circuit that only allows signals to be communicated if a horizontal or near horizontal orientation is detected. In some non-limiting embodiments, such a safety device may utilize one or more gravity sensitive component to determine when the perforating gun 108 has transitioned from a vertical orientation to a suitably deviated orientation, e.g., a horizontal orientation.

The anchor 134 selectively locks the perforating tool 60 against the casing 14. By selectively, it is meant that the anchor 134 may have a pre-activated state that allows the perforating tool 60 to move freely in the wellbore 12 and an activated state wherein the anchor 134 forms a physical connection between the perforating tool 60 and the casing 14. In one embodiment, the anchor 134 may be operatively connected to the marker reader 132 such that the marker reader 132 can send a control signal that actuates the anchor 134 from the pre-activated state to the activated state. In other embodiments, the anchor 134 is operated using an activation signal sent from the controller 152.

The anchor 134 may include extensible arms having a serrated surface, or teeth, that penetrate into the casing 14. The extensible anchor 134 may be moved into engagement with the casing 14 using an actuator operated by electrical power, hydraulic/pneumatics fluids, and/or ballistics. In some embodiments, the extensible anchor 134 may be retracted using the same actuator. In such embodiments, a signal from a downhole device such as a timer or controller (not shown) may be used to initiate the retraction. In other embodiments, a surface signal may be used to retract the anchor 134. In still other embodiments, the anchor 134 may be degradable and disintegrate over a preset time (e.g., twenty four hours).

The firing mechanism 106 initiates the firing of the perforating tool 60. The firing mechanism 106 may be responsive to a control signal transmitted by a downhole device (e.g., the marker reader 132 or the controller 152) or a signal transmitted from the surface. Additionally or alternatively, the firing mechanism 106 may initiate the firing automatically upon expiration of a preset time delay or the occurrence of a specified condition. In some embodiments, the firing mechanism 106 may use a high-order detonation generated by an energetic material to fire the perforating tool 60. In some embodiments, the controller 152 may be operatively connected to the firing mechanism 106. In such embodiments, the controller 152 sends an appropriate command to the firing mechanism 106 to enable the firing mechanism 106 to be responsive to a firing signal from the marker reader 132 or other source.

The perforating gun 108 includes one or more guns or gun sets 138*a, b, c*, each of which includes perforating shaped charges 110. Each gun set 138*a, b, c* can be independently fired by the firing mechanism 106. The firing mechanism 106 may be actuated using any known arrangement, e.g., pressure activated, timer-activated, etc. Other components known to one skilled in the art such as boosters, electrical wiring, connectors, fasteners and detonating cords have been omitted. When fired by the firing mechanism 106, the shaped charges 110 form perforations or tunnels through the casing 14 and in the surrounding formation.

Referring to FIGS. 1-3A-C, in one mode of operation, the work string 48 may be first be used to trip the perforating tool 60 along a vertical section of the well and position the perforating tool 60 at or near a horizontal section well, at which time the perforating tool 60 is released. At this time, the perforating tool 60 is in a "safe" state wherein the perforating gun 108 cannot be fired regardless of what the marker reader 132 detects. If present, the separate safety device (not shown) may separately prevent signals from reaching the detonator (not shown) of the perforating gun 108 if the perforating gun 108 is not sufficiently deviated from vertical.

To "arm" the perforating tool 60, personnel communicate with the perforating tool 60 by operating the pump 56 to flow pressurized fluid into the wellbore 12 to generate a predetermined pressure at the perforating tool 60. Once the pressure sensors 150 detect a threshold pressure differential across the sealing element 130 that the controller 152 interprets as corresponding to the predetermined pressure value, the controller 152 places the perforating tool 60 in an "armed" state. About the same time, the perforating tool 60 moves in a downhole direction using principally the force generated by the pressure differential as shown in FIG. 2. If not already doing so, the marker reader 132 actively (e.g., emitting and detecting a signal) or passively (e.g., detecting a signal only) investigates the wellbore 12 for the presence of the marker 70, which indicates that the desired target depth has been reached.

Figure 3A:
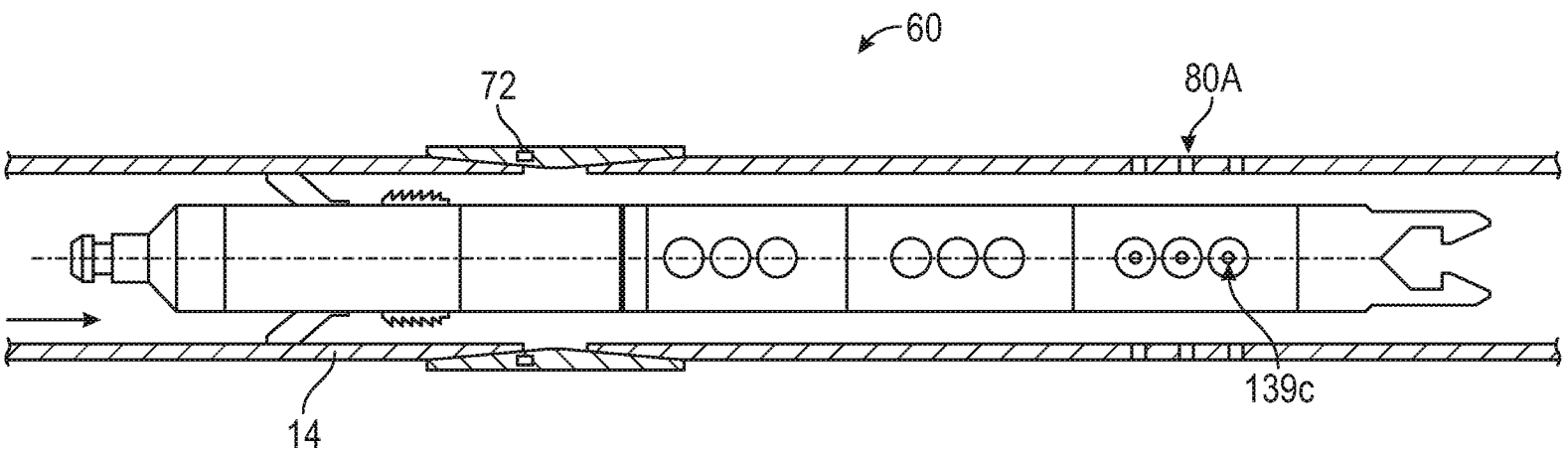
FIGS. 3A-C schematically illustrate a deployment of the FIG. 2 embodiment in a wellbore.
Figure 3B:
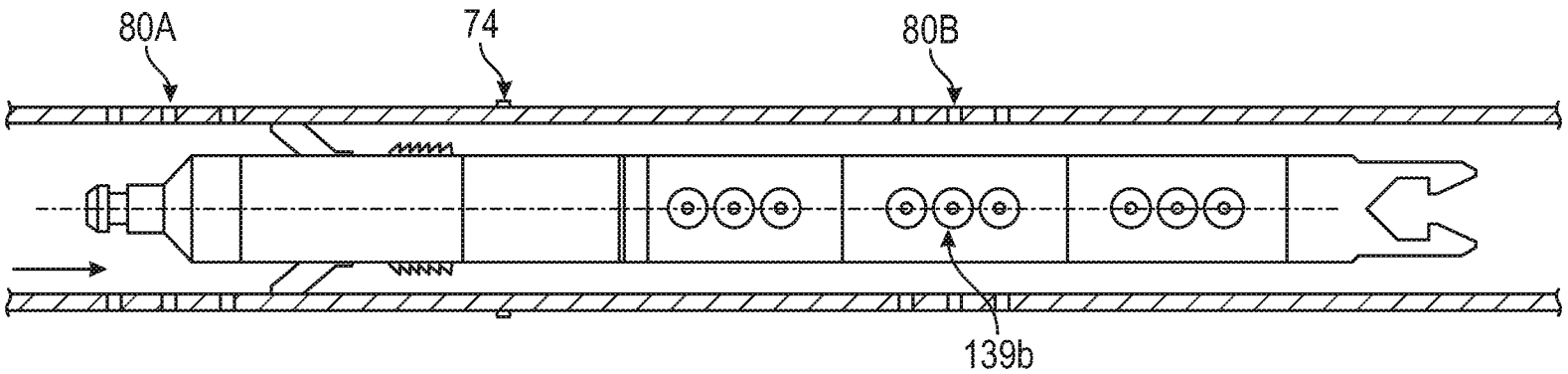

FIG. 3A shows the perforating tool 60 at a first target depth for perforating identified by a perforating marker 72. Once detected by the marker reader 132, the firing mechanism 106 fires one of the perforating gun sections 139C to form perforations 80A in the casing 14 and surrounding formation (not shown). The firing mechanism 106 can only fire the perforating gun 108 if the separate safety device (not shown), if present, has detected a suitably deviated orientation of the perforating gun 108. FIG. 3B shows the perforating tool 60 at a second target depth for perforating identified by a perforating marker 74. Once detected by the marker reader 132, the firing mechanism 136 fires another perforating gun section 139B to form perforations 80B in the casing 14 and surrounding formation (not shown). The process of marker detection and subsequent gun firing continues until all of the target depths for perforating have been perforated. It should be noted that the perforating tool 60 is not secured to the casing 14 or to a conveyance device such as a wireline or coiled tubing when the gun sections 139A-C are fired. Stated differently, the perforating tool 60 may be moving and non-stationary relative to the casing 14. Thus, the perforating tool 60 may be considered "untethered" or "free floating." In embodiments, being untethered or free floating means that there is no non-fluid connection that pushes or pulls the perforating tool 60 or that communicates signals to the perforating tool 60.

Figure 3C:
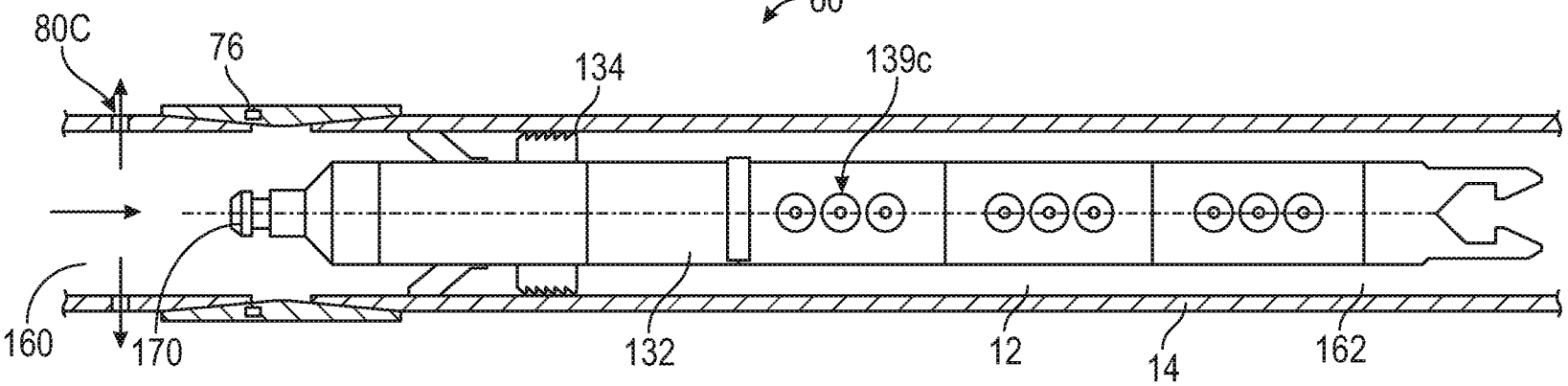

FIG. 3C shows the perforating tool 60 at a final target depth for anchoring identified by an anchoring marker 76. A set of perforations 80C were made by the firing of the perforation gun section 139C. Here, the marker 76 identifies the target depth at which a fluid barrier must be formed to hydraulically isolate the perforations 80*a-c* from the remainder of the wellbore 12. After the marker 76 has been detected by the marker reader 132, the marker reader 132 transmits an activation/command signal that activates the anchor 134. Since the marker reader 132 may be a part of the controller 152, the controller 152 may be considered as sending the activation/command signal. Thereafter, the anchor 134 extend radially outward and physically engage the casing 14. At this point, the perforating tool 60 is fixed to the casing 12 and the sealing element 130 forms a fluid barrier that blocks fluid flow between an uphole wellbore location 160 and a downhole wellbore location 162. The isolation between the uphole and downhole locations may be complete, e.g., more than 90% blockage of fluid flow. In some embodiments, a separate annular body (not shown) may independently or cooperatively with the sealing element 130 form a fluid barrier. Such an annular member may be an inflatable packer, bladder, or other sealing element.

Hydraulic fracturing operations may now begin by operating the pump 58 to deliver fracturing fluid into the wellbore 12. The fracturing fluid flows through the perforations 80A-C and into formation 32 (FIG. 1). The sealing element 130 prevents the fracturing fluid from flowing to the section of the wellbore 12 downhole of the perforating device 60. As is known in the art, the fracturing fluid is pressurized to a value intended to fracture the formation 32. Once fracturing operations are complete, the pump 58 stops operation. Depending on the situation, the perforating tool 60 may be left in the wellbore 12 or retrieved to the surface.

For applications wherein the perforating tool 60 is left in the wellbore 12, some or all of the perforating tool 60 may be formed of a material that disintegrates according to a predetermined time period. In embodiments, the material may disintegrate within one more hours, one or more days, or one or more weeks. The disintegration may be initiated or accelerated by exposure to wellbore fluids, wellbore temperatures/pressures, and/or a substance introduced from the surface. For applications requiring retrieval, the perforating tool 60 may include a suitable latching mechanism 170 (FIG. 3C) that mates with a fishing tool (not shown). The anchor 134 can be configured to be retractable or dissolvable in order to release the perforating tool 60.

Once released, the perforating gun 138 may float back to the surface with the fluid produced by the formation. In some embodiments, the perforating gun 138 may be structured to have the appropriate weight and shape to be carried to the surface by the uphole flowing fluid from the formation. In other embodiments, the perforating gun 138 may include ballast compartments or tanks (not shown) that allows the overall density of the perforating tool 60 to be adjusted. Such ballast device can make the perforating tool 60 neutrally buoyant or positively buoyant, which allows the tool to float back to the surface.

Referring to FIG. 1, it should be understood that the perforating gun 60 is susceptible to numerous embodiments. For example, while the propulsion device 100 may generate a pressure differential to move the perforating gun 60, the propulsion device 100 may also include a self-propelled device such as a wellbore tractor.

The markers 72-76 as described in FIGS. 3A-C may be positioned in the wellbore 12 only for the purpose of identifying a desired depth for perforating or anchoring. However, the marker 70 may be any feature inherent in conventional wells. One non-limiting example of an inherent marker may be a casing collar, which exhibits a recognizable magnetic signature. Casing collars may be used in conjunction with a casing collar locator, the detector 102, which detects casing collars encountered by the perforating tool 60. In other embodiments, the perforating tool 60 may include various types of logging tools to allow correlation with a downhole log that was acquired during a previous run in the wellbore 12. In still other embodiments, the detector 102 does not interact with a specific object positioned in the wellbore 12. For example, the detector 102 may be an odometer or other device that measure the distance traveled by the perforating tool 60. In other embodiments, the detector 102 may detect a predetermined condition, e.g., no movement. The occurrence of the predetermined condition may indicate that the target destination has been reached. In embodiments, the anchoring device 104 may include an expandable bladder, packer, or other inflatable structure for engaging the casing 14.

In still other embodiments, the perforating tool 60 may include stabilizers or centralizers to prop up and center the perforating tool 60 in the wellbore 12.

It is emphasized that the perforating tool 60 is subject to various different arrangements and that components described as separate device may be combined or one component may have multiple functions. For instance, some embodiments may utilize a sealing element 130 that also anchors against the casing 14, thereby eliminating a separate anchor. Also, the marker reader 132 for detecting markers 70 may be a part of the downhole controller 152. Also, the controller 152 may operate any of the components of the perforating tool 60 using suitable command signals, such as the anchor 134.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A well tool for use in a wellbore tubular disposed in a wellbore formed in an earthen formation, comprising:

a perforating gun configured to perforate the wellbore tubular, the perforating gun being configured to fire in response to a firing signal;

a sealing element connected to the perforating gun, the sealing element configured to generate a pressure differential across the perforating gun in response to a fluid pumped into the wellbore tubular;

at least one pressure sensor associated with the sealing element, the at least one pressure sensor being configured to detect a surface transmitted pressure signal;

a detector being configured to detect at least one marker positioned along the wellbore, the at least one marker including a perforating marker associated with a perforating depth;

a controller in signal communication with the at least one pressure sensor and the detector, the controller being configured to transmit the firing signal to the perforating gun only after: (i) the at least one pressure sensor detects the surface transmitted pressure signal, and (ii) the detector detects the perforating marker; and an anchor positioned between the sealing element and the perforating gun, the anchor locking the perforating gun to the wellbore tubular after the perforating gun is fired.

2. The well tool of claim 1, wherein the at least one marker along the wellbore includes a plurality of perforating markers, each perforating marker being associated with a different perforating depth, and wherein the controller is further configured to transmit an additional firing signal to the perforating gun after the detector detects each of the plurality of perforating markers.

3. The well tool of claim 1, wherein the detector is configured to detect an anchoring marker positioned along the wellbore, and wherein the controller is further configured to transmit an activation signal to the anchor, and wherein the anchor locks the perforating gun to the wellbore tubular in response to receiving the activation signal.

4. The well tool of claim 1, wherein the anchor is configured to be in a retracted state when the perforating gun is fired, the perforating gun being unsecured to the wellbore tubular when the anchor is in the retracted state.

5. The well tool of claim 1, wherein:

the detector is configured to detect an anchoring marker positioned along the wellbore, and wherein the controller is further configured to transmit an activation signal to the anchor, and wherein the anchor locks the perforating gun to the wellbore tubular in response to receiving the activation signal; and the anchor is configured to be in a retracted state when the perforating gun is fired, the perforating gun being unsecured to the wellbore tubular when the anchor is in the retracted state.

6. The well tool of claim 1, wherein a safety device is configured to allow a signal to fire the perforating gun if a predetermined orientation is detected.

7. The well tool of claim 1, wherein:

the sealing element is an annular elastomeric member that surrounds the perforating gun;

the anchor includes extensible arms having a serrated surface shaped to penetrate into the wellbore tubular; and the detector is configured to detect a signature that is one of: (i) magnetic, (ii) radioactive, and (iii) electromagnetic signature.

8. The well tool of claim 1, wherein a disintegrating material is used for at least one of: (i) a portion of the perforating gun, (ii) the anchor, (iii) the sealing element, (iv) the detector, (v) the at least one sensor, and (vi) the controller.

9. A method for performing a well operation, comprising:

configuring a perforating gun to only be responsive to a firing signal after receiving a command signal;

propelling a perforating gun through the wellbore tubular by pumping a fluid into a bore of the wellbore tubular, wherein a sealing element surrounding the perforating gun generates a pressure differential that propels the perforating gun;

transmitting a command signal from the surface in the form of pressure in the pumped fluid;

perforating a section of the wellbore by transmitting the firing signal to the perforating gun after receiving the command signal;

anchoring the perforating gun in the wellbore tubular at a depth downhole of the perforated section of the wellbore tubular by using an anchor after perforating the section of the wellbore;

hydraulically isolating the perforated section of the wellbore tubular from a remainder of the wellbore downhole of the perforating gun using a sealing element; and pumping a fracturing fluid into the wellbore tubular to fracture a formation surrounding the perforated section of the wellbore.

10. The method of claim 9, further comprising:

detecting a perforating marker associated with a target depth for perforating the wellbore tubular using a detector; and transmitting the firing signal to the perforating gun after the detector detects the perforating marker by using a controller.

11. The method of claim 9, further comprising:

detecting an anchoring marker associated with a target depth for anchoring the wellbore tubular using a detector; and transmitting an activation signal to the anchor after detecting the anchoring marker by using the controller, wherein the anchor locks the perforating gun to the wellbore tubular in response to receiving the activation signal.

12. The method of claim 9, wherein the anchor is configured to be in a retracted state when the perforating gun is fired, the perforating gun being unsecured to the wellbore tubular when the anchor is in the retracted state.

13. The method of claim 9, further comprising:

detecting a perforating marker associated with a target depth for perforating the wellbore tubular using a detector;

transmitting the firing signal to the perforating gun after the detector detects the perforating marker by using a controller;

detecting an anchoring marker associated with a target depth for anchoring the wellbore tubular using the detector;

transmitting an activation signal to the anchor after detecting the anchoring marker by using the controller, wherein the anchor locks the perforating gun to the wellbore tubular in response to receiving the activation signal, wherein the anchor is configured to be in a retracted state when the perforating gun is fired, the perforating gun being unsecured to the wellbore tubular when the anchor is in the retracted state.

14. The method of claim 13, wherein:

the sealing element is an annular elastomeric member that surrounds the perforating gun;

the anchor includes extensible arms having a serrated surface shaped to penetrate into the wellbore tubular; and the detector is configured to detect a signature that is one of: (i) magnetic, (ii) radioactive, and (iii) electromagnetic signature.

15. The method of claim 9, further comprising:

retrieving the perforating gun by floating the gun to the surface in a fluid produced by a formation surrounding the wellbore.

* * * * *